US007248829B2

(12) United States Patent
Kobayashi

(10) Patent No.: US 7,248,829 B2
(45) Date of Patent: Jul. 24, 2007

(54) SHEET OUTPUT APPARATUS

(75) Inventor: Tsutomu Kobayashi, Ebina (JP)

(73) Assignee: Fuji Xerox Co., Ltd., Tokyo (JP)

( * ) Notice: Subject to any disclaimer, the term of this patent is extended or adjusted under 35 U.S.C. 154(b) by 346 days.

(21) Appl. No.: 11/073,858

(22) Filed: Mar. 8, 2005

(65) Prior Publication Data

US 2006/0038337 A1 Feb. 23, 2006

(30) Foreign Application Priority Data

Aug. 19, 2004 (JP) ..... 2004-239340

(51) Int. Cl.
*G03G 15/00* (2006.01)

(52) U.S. Cl. ..... 399/410; 399/407; 399/408; 270/58.08; 270/58.09; 270/52.18; 270/52.14

(58) Field of Classification Search ..... 399/410, 399/407, 408; 270/58.08, 58.09, 58.05, 52.01, 270/52.07, 52.18
See application file for complete search history.

(56) References Cited

U.S. PATENT DOCUMENTS 4,523,750 A * 6/1985 Hubler ..... 270/58.08
4,750,853 A * 6/1988 Van Soest et al. ..... 414/789.9
5,462,265 A * 10/1995 Mandel et al. ..... 270/58.09
5,826,158 A * 10/1998 Hirano et al. ..... 399/410
6,217,016 B1 * 4/2001 Honmochi et al. ..... 270/37
6,427,997 B1 * 8/2002 Hirota et al. ..... 270/58.12
6,641,129 B2 * 11/2003 Ogita et al. ..... 270/58.08
6,712,349 B2 * 3/2004 Watanabe ..... 270/37
6,726,196 B2 * 4/2004 Kirino ..... 270/58.11
2006/0202402 A1 * 9/2006 Nagata et al. ..... 270/58.08

FOREIGN PATENT DOCUMENTS

JP 8-5585 B 1/1996

* cited by examiner

*Primary Examiner*—Ren Yan
*Assistant Examiner*—Matthew Marini
(74) *Attorney, Agent, or Firm*—Morgan, Lewis & Bockius LLP

(57) ABSTRACT

A sheet output apparatus includes a sheet set generating unit, an information obtaining unit, a decision unit, an output unit, and a control unit. The sheet set generating unit generates a set of sheets by stapling plural sheets. The information obtaining unit obtains image forming information with respect to each of the plural sheets constituting the set of sheets. The decision unit decides whether a pair of sheets including two sheets in which the images formed on the sheets face each other exists or not in the plural sheets. The output unit comes into contact with at least one of the uppermost sheet and the lowermost sheet in the set of sheets to apply a force to the sheet, and outputs the set of sheets in the output direction. The control unit controls the output unit to output the set of sheets.

6 Claims, 7 Drawing Sheets

| | Speed profile |
|---|---|
| SP1 | 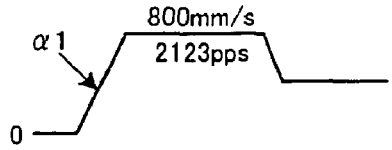  |
| SP2 | 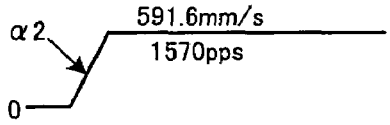  |
| SP3 | 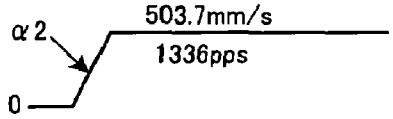  |
| SP4 | 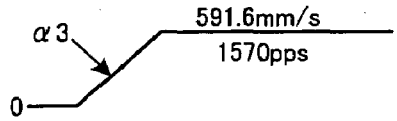  |
Fig. 3
| | Acceleration |
|---|---|
| α1 | 10269.5mm/s$^2$ |
| α2 | 5238.9mm/s$^2$ |
| α3 | 2619.5mm/s$^2$ |
Fig. 4

SHEET OUTPUT APPARATUS

BACKGROUND OF THE INVENTION

1. Field of the Invention

The present invention relates to a sheet output apparatus which binds plural sheets of paper to generate a set of sheets and outputs the generated set of sheets.

2. Description of the Related Art

Generally, an example of relatively frequent office work includes production of a booklet which is performed by binding plural sheets in which the images are formed with an image forming apparatus such as a printer and a copying machine. Conventionally, in many cases, the sheet output apparatus is used as the apparatus which easily performs the binding work. The sheet output apparatus has a mechanism (hereinafter referred to as stapler) which binds the plural sheets by a binding needle (hereinafter referred to as staple) to generate the set of sheets, and the sheet output apparatus outputs the set of sheets generated with the stapler.

Some sheet output apparatuses have a first tray on which the plural sheets are temporarily loaded until the plural sheets are stapled and a second tray in which the stapled set of the plural sheets is finally stored. The generated set of sheets is nipped between a pair of rollers opposite to each other to be output from the first tray toward the second tray. In such sheet output apparatuses, when a size of the sheet or the number of sheets is large, there is a possibility that so-called stack failure is generated in which positions of the output set of sheets are varied on the second tray. Therefore, a technique in which, when the size of the sheet or the number of sheets is large, the set of sheets is output at low speed from the first tray toward the second tray is proposed in order to prevent the stack failure from occurring (for example, see Japanese Patent Application Publication No. 8-5585, pages 2 to 4 and FIG. 5).

Some image forming apparatuses have a function of forming the images on both sides of the sheet. However, when the set of sheets is generated by stapling the plural both-sides sheets in which the images are formed on both sides by the image forming apparatus with stapler to output the set of sheets, there is often generated the problem that the uppermost sheet and the lowermost sheet which are in contact with the pair of rollers for nipping the set of sheets are output while slipped from the set of sheets and the stapled portion is broken. As with the case of the stack failure, the problem can be prevented by outputting the set of sheets at low speed. However, in order to sufficiently prevent the generation of the problem, it is necessary to output the set of sheets at too slow speed, which generates another problem that productivity is remarkably decreased.

SUMMARY OF THE INVENTION

The present invention has been made in view of the above circumstances and provides a sheet output apparatus which can sufficiently prevents the generation of the sheet slip from the set of sheets to output the set of sheets while the decrease in productivity is suppressed.

A first aspect of the invention is a sheet output apparatus having a sheet set generating unit which generates a set of sheets by stapling plural sheets stacked on a predetermined loading surface; an information obtaining unit which obtains image forming information showing that an image is formed on any one of a front side of each sheet, a backside opposite to the front side, or both sides formed by the front side and the backside with respect to each of the plural sheets constituting the set of sheets generated by the sheet set generating unit; a decision unit which decides whether a pair of sheets including two sheets in which the formed images face each other exists or not in the plural sheets constituting the set of sheets generated by the sheet set generating unit based on the image forming information obtained by the information obtaining unit; an output unit which comes into contact with at least one of the uppermost sheet and the lowermost sheet in the set of sheets generated by the sheet set generating unit to apply a force outputting the set of sheets toward a predetermined output direction to the sheet, the output unit outputting the set of sheets toward the output direction by one of a predetermined first output force and a second output force smaller than the first output force; and a control unit which controls the output unit to output the set of sheets by the first output force when the decision result by the decision unit shows that the pair of sheets does not exist in the plural sheets constituting the set of sheets, the control unit controlling the output unit to output the set of sheets by the second output force when the decision result by the decision unit shows that the pair of sheets exists in the plural sheets constituting the set of sheets.

A second aspect of the invention is a sheet output apparatus having a sheet set generating unit which generates a set of sheets by stapling plural sheets stacked on a predetermined loading surface; an information obtaining unit which obtains image forming information showing that an image is formed on any one of a front side of each sheet, a backside opposite to the front side, or both sides formed by the front side and the backside with respect to each of the plural sheets constituting the set of sheets generated by the sheet set generating unit; a decision unit which decides whether a pair of sheets including two sheets in which the formed images face each other exists or not in the plural sheets constituting the set of sheets generated by the sheet set generating unit based on the image forming information obtained by the information obtaining unit; an output unit which comes into contact with at least one of the uppermost sheet and the lowermost sheet in the set of sheets generated by the sheet set generating unit to apply a force outputting the set of sheets toward a predetermined output direction to the sheet, the output unit outputting the set of sheets toward the output direction by one of a predetermined first output force and a second output force smaller than the first output force; and a control unit which controls the output unit to output the set of sheets by the first output force when the decision result by the decision unit shows that the pair of sheets does not exist in the plural sheets constituting the set of sheets, the control unit controlling the output unit to output the set of sheets by the first output force or the second output force according to the decision result about a predetermined condition further performed by the decision unit when the decision result by the decision unit shows that the pair of sheets exists in the plural sheets constituting the set of sheets.

As an example of "the pair of sheets including two sheets in which the formed images face each other" of which the decision unit makes the decision of the existence, there described the pair of sheets including a both-sides sheet and the surface-side sheet which are in contact with each other, in the set of sheets including the both-sides sheet in which the images are formed on the front side and the backside and the front-side sheet in which the image is formed on the front side. A toner used for the image formation in the image forming apparatus such as a copying machine has a lubrication effect, and when the images are in contact with each other while facing each other, sometimes the lubrication effect of the toner forming each image acts synergistically to remarkably decrease frictional force generated between the sheets. Namely, in the pair of sheets, there is a high possibility that the frictional force becomes very small between the sheets. When the force is applied to the set of sheets including the pair of sheets by the output unit, the force is not sufficiently transmitted between two sheets constituting the pair of sheets, although the force should originally be transmitted to the inside of the set of sheets by the frictional force generated between the sheets. As a result, the set of sheets are divided into a group of sheets to which the force is transmitted from the output unit and a group of other sheets, and a reaction against the binding force generated by, for example, the staple is applied between the two groups of sheets.

In order to efficiently output the set of sheets to improve the productivity, it is desirable that the set of sheets is output by applying as much output force as possible with the output unit to accelerate the set of sheets with the large acceleration. However, in the existence of the pair of sheets in the set of sheets, when the large output force is applied to the set of sheets, the reaction against the binding force applied between the two groups of sheets is increased. For example, in the extreme case where the set of sheets are formed by the both-sides sheets only, when the large output force is applied to the set of sheets, there is likely to generate the problem in that the large output force acts intensively on the sheet with which the output unit is in direct contact and the sheet escapes from the binding force to slip from the set of sheets, thereby the stapled portion is broken.

In both the first and second aspects of the sheet output apparatus of the invention, the decision unit decides whether the pair of sheets exists or not, the pair of sheets causing the problem that the frictional force is decreased to make the sheet slip from the set of sheets. When the decision result shows that the pair of sheets does not exist, i.e. when there is a low possibility that the sheet slip from the set of sheets is generated, the set of sheets is accelerated by the first output force which is the relatively large force. Therefore, the decrease in productivity is suppressed by appropriately accelerating the set of sheets with the large output force while the sheet slip from the set of sheets can sufficiently be prevented from generating.

In the sheet output apparatus of the invention, in addition to the image forming information, the information obtaining unit may obtain the sheet count information showing the number of sheets of the plural sheets constituting the set of sheets, the stapling information showing whether the sheet set generating unit staples the plural sheets at one point or the plural points, and the density information showing the image density which is the occupation ratio of the image to a sheet surface on which the image is formed with respect to each of the plural sheets constituting the set of sheets; in addition to the decision whether the pair of sheets exists in the plural sheets constituting the set of sheets, the decision unit may decide whether predetermined conditions are satisfied or not when the predetermined conditions are the sheet count condition that the sheet count shown by the sheet count information is lower than the predetermined number of sheets, the stapling condition that the plural stapling points shown by the stapling information exist, and the image density condition that image density is not more than a predetermined value in two sheets facing each other in the pair of sheets; and the control unit may control the output unit to output the set of sheets by the second output force, when the decision unit decides that the pair of sheets exists in the plural sheets constituting the set of sheets and decides that none of the sheet count condition, the stapling condition, or the image density condition is satisfied.

According to the sheet output apparatus of the invention, the set of sheets is slowly accelerated by the second output force, when there is an extremely high possibility that the sheet slip from the set of sheets is generated because the pair of the sheets exists in the plural sheets constituting the set of sheets, the number of sheets is large, the plural sheets are stapled at one point, and the image density is not high in the two sheet surfaces opposite to each other in the pair of sheets. Namely, according to the sheet output apparatus of the invention, the sheet slip can be prevented from generating while the decrease in productivity is kept to the minimum.

As described above, the invention can provide the sheet output apparatus which can sufficiently prevents the generation of the sheet slip from the set of sheets to output the set of sheets while the decrease in productivity is suppressed.

BRIEF DESCRIPTION OF THE DRAWINGS

Embodiments of the present invention will be described in detail based on the following figures, wherein:

FIG. 3 shows four speed profiles for an output speed of the set of sheets;

FIG. 4 shows acceleration when the output speed reaches a predetermined value from zero in each speed profile shown in FIG. 3;

DETAILED DESCRIPTION OF THE INVENTION

Referring now to the accompanying drawings, embodiments of the invention will be described below.

Figure 1:
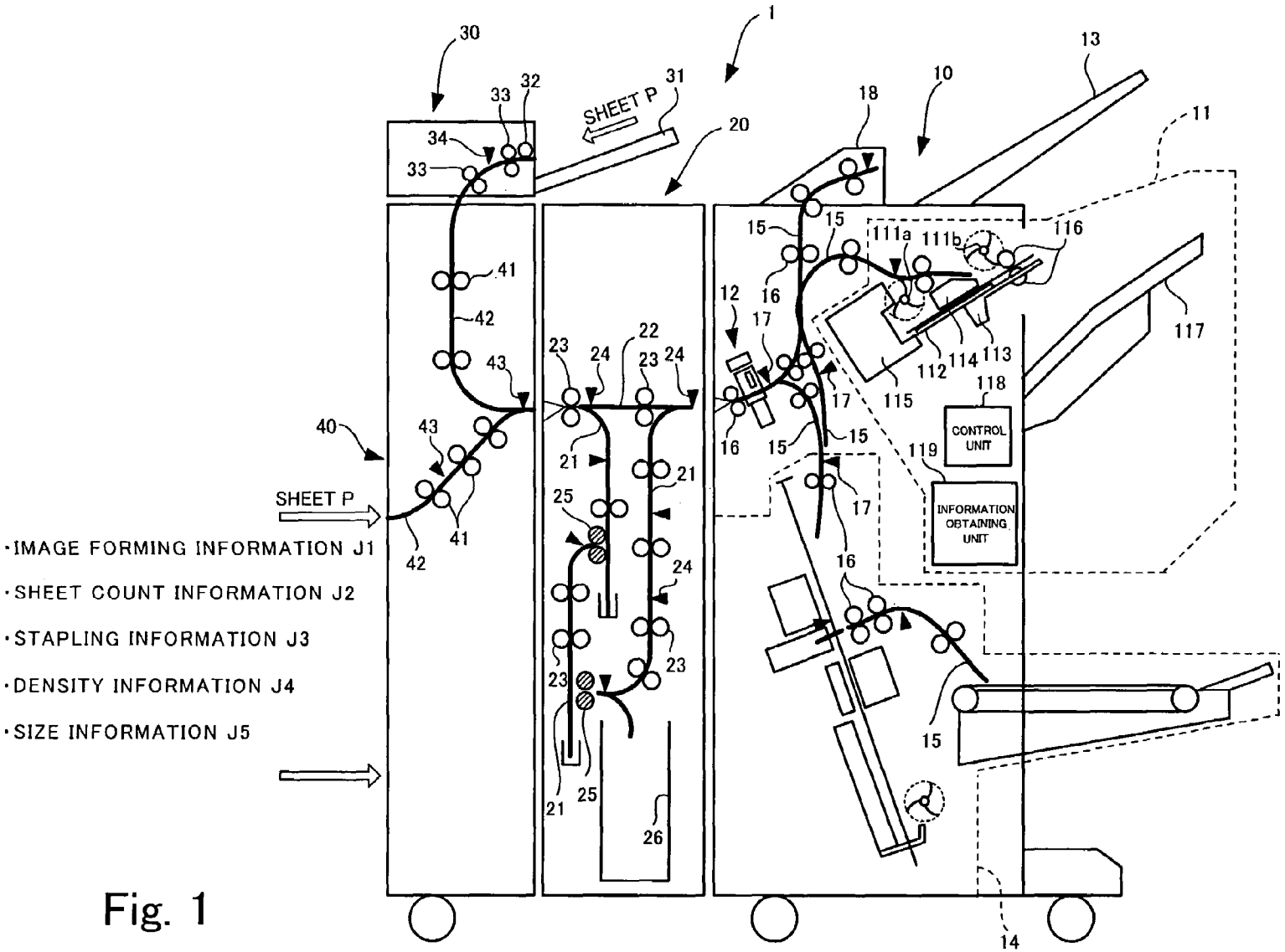
FIG. 1 shows an example of a post-processing apparatus including a sheet output apparatus according to an embodiment of the invention.

FIG. 1 shows an example of a post-processing apparatus including a sheet output apparatus according to an embodiment of the invention.

A post-processing apparatus 1 shown in FIG. 1 includes a final processing apparatus 10, a folding apparatus 20, an interposer 30, and an interface module 40, and receives the sheet on which the image is formed from an image forming apparatus (not shown) to perform the folding process or the stapling process of stapling the plural sheets.

The final processing apparatus 10 includes a sheet output apparatus 11, a punching apparatus 12, a top tray 13, and a booklet 14. The sheet output apparatus 11 included in the final processing apparatus 10 corresponds to the sheet output apparatus according to the embodiment of the invention.

In the example of FIG. 1, the sheet P on which the image is formed and the later-mentioned plural pieces of information such as image forming information J1, sheet count information J2, stapling information J3, density information J4, and size information J5 are transmitted from the image forming apparatus (not shown) to the interface module 40. At this point, the image forming information J1, the sheet count information J2, the stapling information J3, and the density information J4 correspond to examples of image forming information, sheet count information, stapling information, and density information which are described in the invention respectively.

A sheet tray 31 on which a user sets the sheet P is provided in the interposer 30. The sheet P set on the sheet tray 31 is taken in by a pickup roller 32 and conveyed to the interface module 40 by pairs of conveying rollers 33. A sheet sensor 34 arranged in the interposer 30 monitors the movement of the sheet P in the interposer 30.

Plural pairs of conveying rollers 41 and a sheet conveying path 42 formed by guide members (not shown) provided between the pairs of conveying rollers 41 are formed in the interface module 40. The sheet P delivered from the image forming apparatus (not shown) and the interposer 30 is conveyed to the folding apparatus 20 arranged in a subsequent stage of the interface module 40 through the sheet conveying path 42. Plural sheet sensors 43 arranged in the sheet conveying path 42 monitor the passage of the sheet P through the sheet conveying path 42. The plural pieces of information J1 to J5 transmitted from the image forming apparatus are transmitted to the sheet output apparatus 11 included in the final processing apparatus 10.

Two kinds of conveying paths of a folding sheet conveying path 21 and a normal conveying path 22 are formed by plural pairs of conveying rollers 23 and guide members (not shown) in the folding apparatus 20. The sheet P passes through the folding sheet conveying path 21 when the user directs that the folding process such as a Z-shaped folding is performed. In the normal conveying path 22, the sheet P is directly conveyed to the final processing apparatus 10 arranged in the subsequent stage of the folding apparatus 20. Plural sheet sensors 24 arranged in the conveying paths 21 and 22 monitor the passage of the sheet P. A pair of folding rollers 25 are arranged in midstream of the folding sheet conveying path 21. The sheet to which the folding process is performed is folded by a nip between the pair of folding rollers 25 while conveyed through the folding sheet conveying path 21. The folding apparatus 20 also includes a storage unit 26 in which the folded sheet P is stored.

As described above, the final processing apparatus 10 includes the sheet output apparatus 11, the punching apparatus 12, the top tray 13, and the booklet 14, and sheet conveying paths 15 which connect these elements are formed by plural pairs of conveying rollers 16 and guide members (not shown). Plural sheet sensors 17 arranged in the conveying paths 15 monitor the passage of the sheet.

The sheet P delivered to the final processing apparatus 10 first passes through the punching apparatus 12, and the punching process is performed to the sheet P when the user gives a direction to perform the punching process. Then, the sheet P, after passing through the punching apparatus 12, is conveyed to the sheet output apparatus 11 when the user gives the direction to perform the stapling process. The sheet P is conveyed to the booklet 14 when the user gives the direction to perform the booklet process, in which the stapling process is performed to the center of the plural sheets to form the set of sheets, and the set of sheets is folded at the center. When the user gives no direction, the sheet P is conveyed to a top tray outlet 18 and output from the top tray outlet 18 to the top tray 13.

In the post-processing apparatus 1 shown in FIG. 1, since a feature of the invention is the sheet output apparatus 11, the sheet output apparatus 11 will mainly be described in the following description.

The sheet output apparatus 11 includes first and second paddles 111*a* and 111*b*, a first tray 112, a shelf 113, a tamper 114, a stapler 115, a pair of output rollers 116, a second tray 117, a control unit 118, and an information obtaining unit 119. The stapler 115, the pair of output rollers 116, and the information obtaining unit 119 correspond to examples of a sheet set generating unit, an output unit, and an information obtaining unit which are described in the invention respectively. The control unit 118 corresponds to an example of decision unit and a control unit which are described in the invention.

In the sheet output apparatus 11, operations of elements other than the control unit 118 and the information obtaining unit 119 which will be described later, will first be described.

Figure 2:
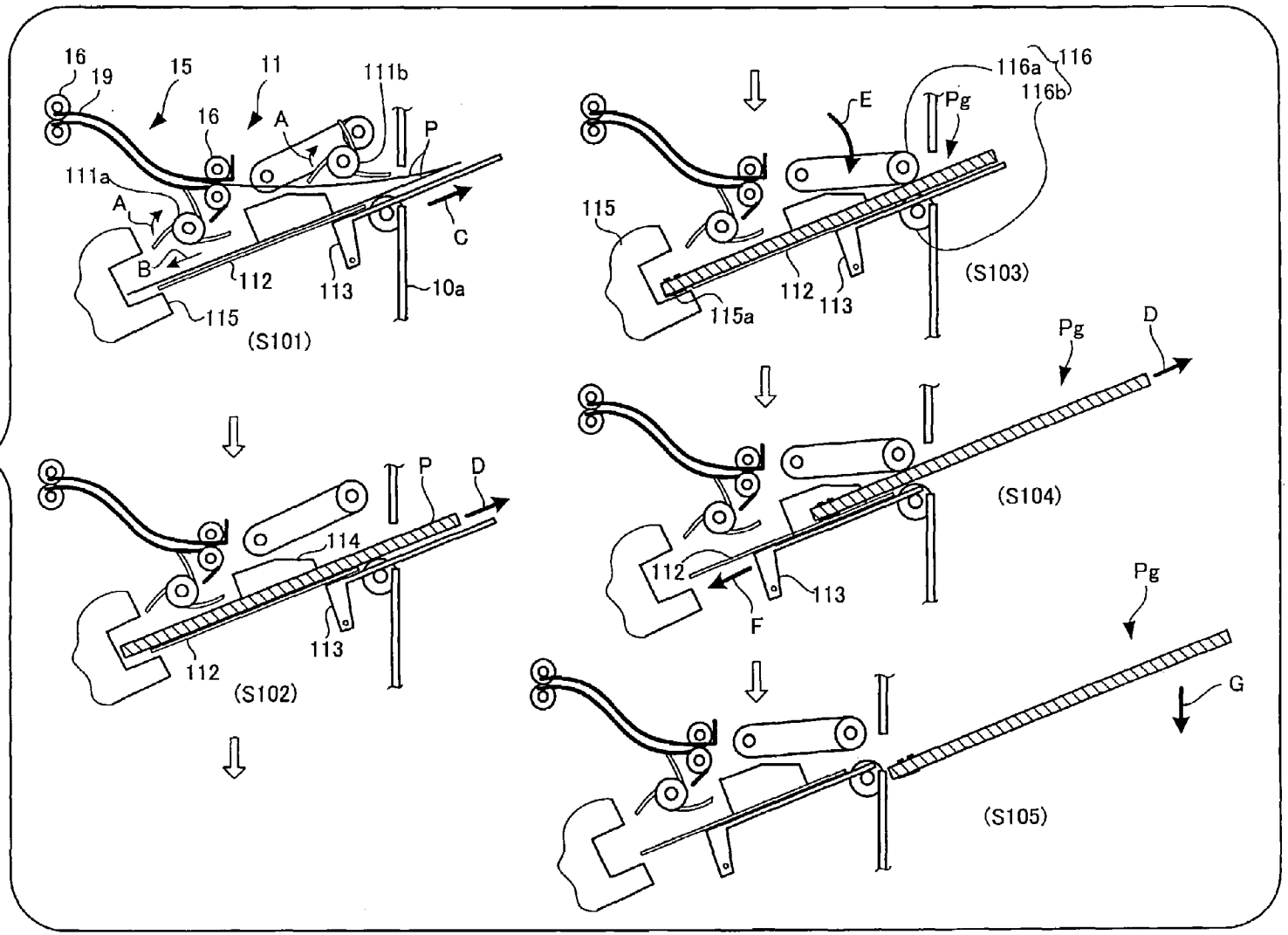
FIG. 2 is a schematic view for explaining operation of the sheet output apparatus shown in FIG. 1.

FIG. 2 is a schematic view explaining the operation of the sheet output apparatus shown in FIG. 1.

FIG. 2 schematically shows steps in which the plural sheets P are sequentially conveyed to the sheet output apparatus 11 and the sheets P are output through the stapling process.

As shown in Step S101 of FIG. 2, when the plural sheets P are sequentially conveyed to the sheet output apparatus 11, the first and second paddles 111*a* and 111*b* which are rotated in an arrow A directions respectively convey the sheet P on the first tray 112 in an arrow B direction until a front end of the sheet P butts against the stapler 115. At this point, the shelf 113 extends out in an arrow C direction to the outside of a wall 10*a* of the final processing apparatus 10 (see FIG. 1) to support a part of the sheet P which protrudes from the first tray 112.

When all the sheets P which form the set of sheets are loaded on the first tray 112 and the shelf 113, the tamper 114 is moved in a direction (from the back to the front side direction of the sheet space of FIG. 2) orthogonal to a sheet set output direction D so that edges of the sheets extending in the sheet set output direction D are aligned (Step S102). At this point, the second paddle 111*b* is retracted to an evacuation position (not shown).

Then, an upper roller 116*a*, which constitutes the pair of output rollers 116 and presses the sheets loaded on the first tray 112 and the shelf 113 from above, is moved in an arrow E direction to nip the sheets with a lower roller 116*b*, which supports the sheets from beneath. The stapler 115 staples the sheets nipped between the pair of output rollers 116 to generate the set of sheets Pg (Step S103).

When the set of sheets Pg is generated by the process of Step S103, the upper and lower rollers 116*a* and 116*b* which constitute the pair of output rollers 116 are rotated in conjunction with each other by a stepping motor (not shown) to deliver the set of sheets Pg in an arrow D direction (Step S104). At this point, the shelf 113 is moved in an arrow F direction and stored under the first tray 112.

The set of sheets Pg output by the process of Step S103 then falls down by its own weight in an arrow G direction toward the second tray 117 shown in FIG. 1 and is loaded on the second tray 117 (Step S105).

In the sheet output apparatus 11, the set of sheets Pg is generated from the plural sheets P by the operations of Step S101 to Step S105 described above, and the set of sheets Pg is output toward the second tray 117.

In Step S104, when the set of sheets Pg is output by the upper and lower rollers 116*a* and 116*b* which constitute the pair of output rollers 116, the control unit 118 shown in FIG. 1 controls the rotations of the upper and lower rollers 116*a* and 116*b* so that an output speed of the set of sheets Pg is changed according to one speed profile selected from four speed profiles described below.

FIG. 3 shows the four speed profiles for the output speed of the set of sheets. FIG. 4 shows acceleration when the output speed reaches a predetermined value from zero in each speed profile shown in FIG. 3. FIG. 3 shows first to fourth speed profiles SP1 to SP4, and FIG. 4 shows first to third accelerations α1 to α3. Among the first to third accelerations α1 to α3, the first acceleration α1 is the largest acceleration and the third acceleration α3 is the smallest acceleration. The upper and lower rollers 116*a* and 116*b* come into contact with the uppermost sheet and the lowermost sheet in the set of sheets Pg respectively. In order to output the sheet at the first acceleration α1, predetermined first output force is applied to the sheets with which the upper and lower rollers 116*a* and 116*b* come into contact. In order to output the sheet at the third acceleration α3, second output force smaller than the first output force is applied to the sheets with which the upper and lower rollers 116*a* and 116*b* come into contact.

As mentioned later, the first and fourth speed profiles SP1 and SP4 are used when the size of each sheet constituting the set of sheets which is an object of the stapling process is the normal size which is relatively often used, and the second and third speed profiles SP2 and SP3 are the limiting speed profiles used when the size of each sheet is larger than the normal size. In the embodiment, the feature of the invention is the first and fourth speed profiles SP1 and SP4. Therefore, the first and fourth speed profiles SP1 and SP4 will mainly be described below, and the second and third speed profiles SP2 and SP3 will only be briefly described.

In the first speed profile SP1, the output speed of the set of sheets is increased from zero to 800 mm/s at the first acceleration α1 (10269.5 mm/s$^2$) shown in FIG. 4, the output speed of 800 mm/s is maintained for a predetermined time until a rear end of the set of sheets reaches the pair of output rollers 116, the output speed is decreased to a predetermined speed to finally output the set of sheets at the predetermined speed. The maximum speed of 800 mm/s in the first speed profile SP1 means that the pair of output rollers 116 is driven by the stepping motor (not shown) at the rotation of 2123 pps. In the first speed profile SP1, variations in orientation of the sets of sheets loaded on the second tray 117 shown in FIG. 1 and variations in orientation of the sheets constituting each set of sheets are prevented by finally decreasing the output speed. When the set of sheets is accelerated in the first speed profile SP1, the large force is applied to the uppermost sheet and the lowermost sheet which are in direct contact with the pair of output rollers 116. In addition, the first speed profile SP1 can output the set of sheets at the shortest time including the time during which the set of sheets passes through the pair of output rollers 116, thus placing the greatest emphasis on productivity.

In the second speed profile SP2, the output speed of the set of sheets is increased from zero to 591.6 mm/s at the second acceleration α2 (5238.9 mm/s$^2$) shown in FIG. 4, and the set of sheets is output at the speed of 591.6 mm/s. The final output speed of 591.6 mm/s in the second speed profile SP2 means that the pair of output rollers 116 is driven by the stepping motor (not shown) at the rotation of 1570 pps. In the third speed profile SP3, the output speed of the set of sheets is increased from zero to 503.7 mm/s at the second acceleration α2 (5238.9 mm/s$^2$) shown in FIG. 4, and the set of sheets is output at the speed of 503.7 mm/s. The final output speed of 503.7 mm/s in the third speed profile SP3 means that the pair of output rollers 116 is driven by the stepping motor (not shown) at the rotation of 1336 pps.

In the fourth speed profile SP4, the output speed of the set of sheets is increased at the third acceleration α3 (2619.5 mm/s$^2$) shown in FIG. 4 from zero to the same output speed of 591.6 mm/s as the second speed profile SP2, and the set of sheets is output at the speed of 591.6 mm/s. When compared with the first speed profile SP1, the speed is slow when the set of sheets passes through the pair of output rollers 116 and the acceleration is also small in the fourth speed profile SP4. Therefore, although the fourth speed profile SP4 is inferior to the first speed profile SP1 in the productivity, the fourth speed profile SP4 is superior in safety, because the force (output force) applied to the uppermost sheet and the lowermost sheet with which the pair of output rollers 116 is in direct contact is relatively small when the set of sheets is accelerated.

The selection of the speed profile from the four speed profiles is performed based on the image forming information J1, the sheet count information J2, the stapling information J3, the density information J4, and the size information J5 which are obtained from the image forming apparatus through the interface module 40 by the information obtaining unit 119 shown in FIG. 1.

The image forming information J1 shows on which one of the front side of the sheet, the backside, and the both sides the image is formed for each of the plural sheets constituting the set of sheets. The sheet count information J2 shows the number of the sheets constituting the set of sheets. The stapling information J3 shows whether the plural sheets are stapled at one point or two points in performing the stapling process to the set of sheets. The density information J4 shows that the image density which is the occupation ratio of the image to a sheet surface on which the image is formed with respect to each of the plural sheets constituting the set of sheets. The image density is computed from the amount of toner used for the image formation on the surface of the sheet. The size information J5 shows the size of the sheet with respect to each set of sheets.

Figure 5:
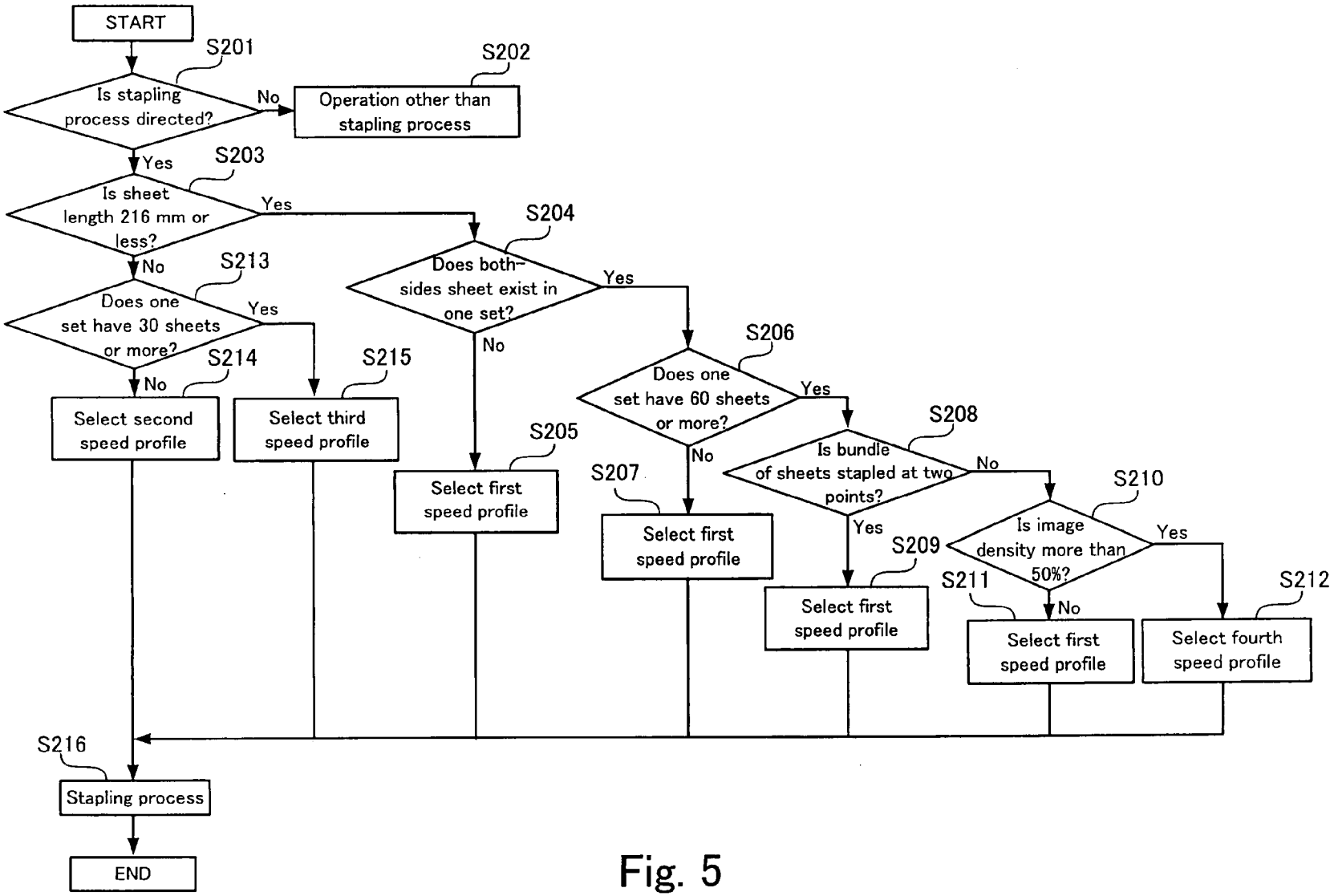
FIG. 5 is a flowchart showing a process of selecting the speed profile in a control unit.

FIG. 5 is a flowchart showing the process of selecting the speed profile in the control unit.

When the process shown in the flowchart of FIG. 5 is started, it is decided whether the user directs that the stapling process be performed (Step S201). When the user does not direct that the stapling process is performed (No in Step S201), the booklet process or the processes except for the stapling process such as the output of the sheet to the top tray 13 shown in FIG. 1 is performed (Step S202). The processes other than the stapling process do not have relation with the invention, so that the processes other than the stapling process are not described in detail here.

On the other hand, when the user directs that the stapling process be performed (Yes in Step S201), the speed profile for the output speed of the set of sheets is selected from the four speed profiles by the sequence from Step S203 described below.

In Step S203, it is decided whether the size of each sheet constituting the set of sheets of the object of the stapling process shown by the size information J5 is the normal size whose length in the output direction is 216 mm or less. The processes, which are performed when it is decided that the size of the sheet is larger than the normal size (No in Step S203), will be described later, while at first the processes from Step S204 will be described below when it is decided that the size of the sheet is the normal size (Yes in Step S203).

In the process of Step S204, according to the image forming information J1, it is decided whether the both-sides printing sheet in which the images are formed on the both sides (hereafter referred to as a both-sides sheet) exists in the plural sheets constituting the set of sheets which is the object of the stapling process. When it is decided that the both-sides sheet does not exist (No in Step S204), the first speed profile SP1 shown in FIG. 3 is selected as the speed profile (Step S205), and the flow goes to the next step (Step S216).

On the other hand, when it is decided that the both-sides sheet exists (Yes in Step S204), according to the size information J5, it is decided whether the number of sheets constituting the set of sheets which is the object of the stapling process is 60 or more (Step S206). When it is decided that the number of sheets is lower than 60 (No in Step S206), the first speed profile SP1 is selected as the speed profile (Step S207), and the flow goes to the next step (Step S216). Namely, the size information J5 shows the sheet count condition that the number of sheets is lower than 60. When the sheet count condition is satisfied, the first speed profile SP1 is also selected.

On the other hand, when it is decided that the number of sheets is 60 or more (Yes in Step S206), according to the stapling information J3, it is decided whether the set of sheets which is the object of the stapling process is stapled at two points (Step S208). When it is decided that the set of sheets is stapled at two points (Yes in Step S208), the first speed profile SP1 is selected as the speed profile (Step S209), and the flow goes to the next step (Step S216). Namely, the stapling information J3 shows the stapling condition that the set of sheets is stapled at two points. When the stapling condition is satisfied, the first speed profile SP1 is also selected.

When it is decided that the set of sheets is not stapled at two points (No in Step S208), with respect to the set of sheets which is the object of the stapling process and includes at least one both-sides sheet, it is decided whether both the image density is more than 50% in the surfaces facing each other in two sheets (Step S210). The density information corresponding to the backside of each both-sides sheet and the density information corresponding to the sheet which is in contact with the backside of each both-sides sheet are selected among the pieces of density information corresponding to the sheets constituting the set of sheets. Then, according to each density information, it is decided whether both the image density in the backside of the both-sides sheet and the image density of the sheet which is in contact with the backside are more than 50%. When the both-sides sheets are in contact with each other, it is decided whether both the image density in the backside of one of the both-sides sheets and the image density in the front side of the other both-sides sheet are more than 50%.

As a result of the decision process in Step S210, when it is decided that both the image density is not more than 50% in the surfaces facing each other in two sheets (No in Step S210), the first speed profile SP1 is selected as the speed profile (Step S211), and the flow goes to the next step (Step S216). Namely, the image density in the backside of the both-sides sheet and the image density of the sheet which is in contact with the backside are shown by each piece of density information J4. When the image density condition that both the image density is 50% or less is satisfied, the first speed profile SP1 is also selected.

On the other hand, when it is decided that both the image density is more than 50% in the surfaces facing each other in two sheets (Yes in Step S210), unlike the above cases, the fourth speed profile SP4 is selected as the speed profile (Step S212), and the flow goes to the next step (Step S216).

Then, the process which is performed when it is decided that the size of the sheet is the large size exceeding the normal size (No in Step S203) is described.

In this case, it is decided whether the number of sheets shown by the size information J5 is 30 or more (Step S213). When it is decided that the number of sheets is lower than 30 (No in Step S213), the second speed profile SP2 is selected as the speed profile (Step S214), and the flow goes to the next step (Step S216). When it is decided that the number of sheets is 30 or more (Yes in Step S213), the third speed profile SP3 is selected as the speed profile (Step S215), and the flow goes to the next step (Step S216).

When one speed profile is selected from the first to fourth speed profiles SP1 to SP4 through the processes of Step S203 to Step S215, the stapling process described referring to FIG. 2 is performed in Step S216, and the set of sheets is output according to the selected speed profile. Then, the flow is ended.

Thus, in the process of selecting the speed profile shown by the flowchart of FIG. 5, the fourth speed profile SP4 in which the safety is emphasized is selected for the set of sheets including the normal size sheet which is often used, only when all the following conditions are satisfied. Namely, the both-sides sheet exists in the set of sheets, the number of sheets is 60 or more, the set of sheets is stapled at one point, and both the image density is more than 50% in the surfaces facing each other in two sheets. In other cases, the first speed profile SP1 in which the productivity is emphasized is selected.

As described above, in the both-sides sheet, there is the risk of reducing the frictional force between the stapled sheets to generate the sheet slip from the set of sheets. When the number of sheets is large, the force applied to the uppermost sheet and the lowermost sheet in the set of sheets is inadequately transmitted to the inside of the set of sheets, and the sheet slip is more likely to be generated. When the set of sheets is stapled at one point, the binding force to each sheet is weakened, thus increasing the possibility of the sheet slip. When the image density is high, the frictional force is further decreased between the sheets, so that the possibility that the sheet slip is generated is further increased. In order to secure the safety to a maximum extent, it may be safe to control the speed so as to select the fourth speed profile SP4 whenever the both-sides sheet exists in the set of sheets. The decrease in productivity is suppressed even in the above control. However, in the embodiment, the above three criteria are added based on the following experimental data, and the fourth speed profile SP4 is selected only when there is the risk for all the four criteria. Therefore, the further improvement of the productivity is realized.

Figure 6:
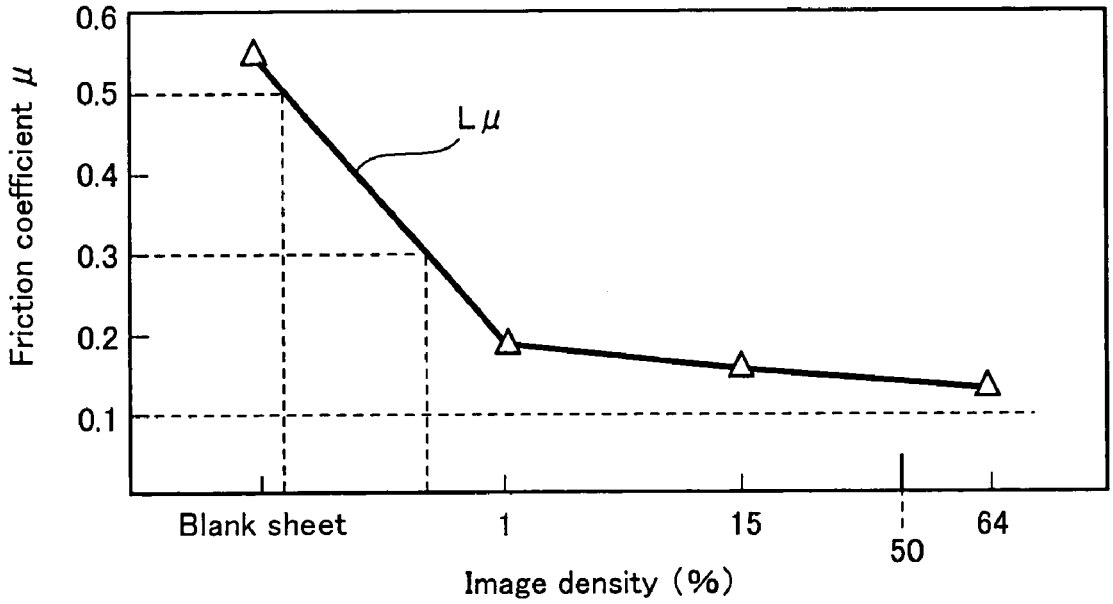
FIG. 6 is a graph showing a friction coefficient between sheets when two both-sides sheets whose image density differs from each other are placed on each other.
Figure 7:
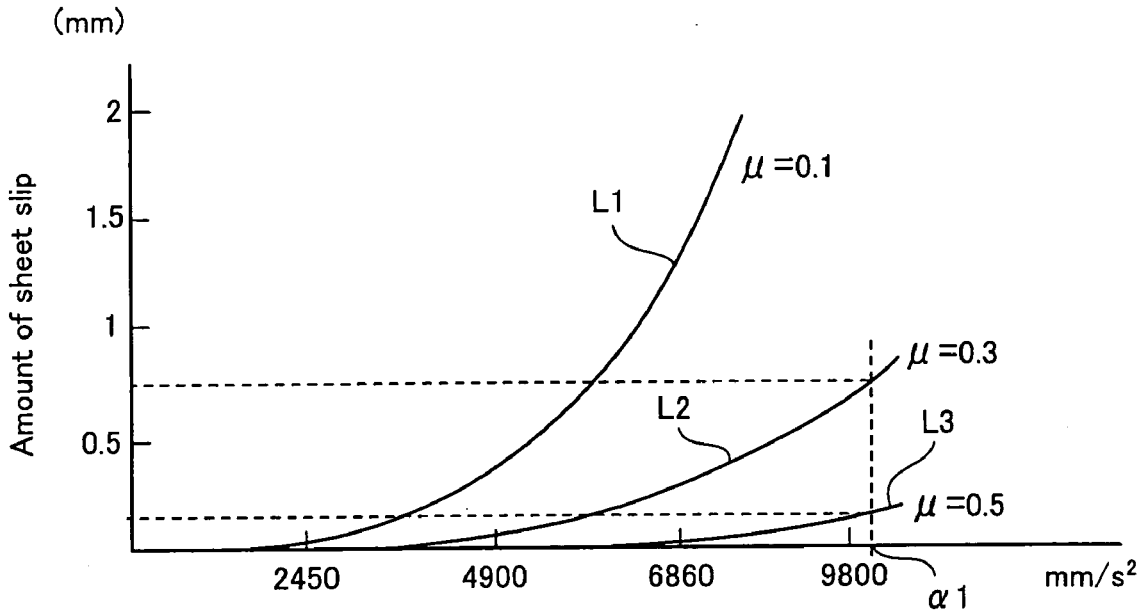
FIG. 7 is a graph showing a change in an amount of sheet slip in each group of sheets of three kinds of groups of sheets in which the large amount of three kinds of both-sides sheets whose friction coefficients differ from one another is stacked, when the three kinds of groups of sheets are output without stapling the sheets by the apparatus equal to the sheet output apparatus shown in FIGS. 1 and 2 while acceleration is changed during output.

FIG. 6 is a graph showing a friction coefficient between the sheets when two both-sides sheets whose image density differs from each other are placed on each other. FIG. 7 is a graph showing the amount of sheet slip in each group of sheets of three kinds of groups of sheets in which the large amount of three kinds of both-sides sheets whose friction coefficients differ from one another is stacked, when the three kinds of groups of sheets are output without stapling the sheets by the apparatus equal to the sheet output apparatus shown in FIGS. 1 and 2 while the acceleration is changed during the output. In the experiment, the both-sides sheets in which the images are formed on the both sides with the color toner which most remarkably decreases the frictional force between the sheets.

In FIG. 6, a horizontal axis represents the image density, and a vertical axis represents the friction coefficient. As can be seen from the graph shown in FIG. 6, the friction coefficient is decreased as the image density is increased. In FIG. 7, the horizontal axis represents the acceleration, and the vertical axis represents the amount of sheet slip. As can be seen from the graph shown in FIG. 7, the amount of sheet slip is increased as the acceleration is increased, and the amount of sheet slip is increased as the friction coefficient between the sheets is decreased.

The experiment for obtaining the graph of FIG. 7 is performed in the strict state in which there is the risk for all the three criteria except the criterion concerning the image density. Namely, in the experiment of FIG. 7, all the stacked sheets are formed by the both-sides sheets in which the images are formed on the both sides with the color toner, the large amount of sheets is stacked, and the sheets are stacked without stapling the sheets. The graph of FIG. 7 shows first to third lines L1 to L3 corresponding respectively to three kinds of friction coefficients ($\mu$=0.1, $\mu$=0.3, $\mu$=0.5) whose values are different from one another.

On the other hand, from a line L$\mu$ shown in the graph of FIG. 6, except for the line L1 of FIG. 7 corresponding to the friction coefficient of $\mu$=0.1, it is found that the two lines L2 and L3 of FIG. 7 correspond to the image density lower than 50% which is the criterion concerning the image density. When the two lines L2 and L3 shown in FIG. 7 are observed, in the group of sheets in which both-sides sheets having the sufficiently small image density are stacked, it is found that the amount of sheet slip generated in accelerating the group of sheets at the large acceleration $\alpha$1 (see FIG. 4) in the first speed profile SP1 is lower than 1 mm. When the image density is low, from the graphs shown in FIGS. 6 and 7, it is found that the sheet slip from the set of sheets can sufficiently be suppressed, even if the both-sides sheet exists in the set of sheets which is the object of the stapling process, the number of sheets is large, and the set of sheets is stapled at one point.

As described above referring to FIGS. 1 to 7, according to the sheet output apparatus 11 of the embodiment, the generation of the sheet slip from the set of sheets can be sufficiently suppressed to output the set of sheets while the decrease in productivity is suppressed.

In the embodiment, the control unit which decides whether the both-sides sheet exists in the set of sheets is shown as an example of "the decision unit which decides whether the pair of sheets including two sheets in which the formed images face each other exists in the plural sheets constituting the set of sheets" which is described in the invention. However, the invention is not limited to the embodiment. The decision unit described in the invention may be one which decides whether the pair of sheets including two sheets, the sheet in which the image is formed on the backside and the sheet in which the image is formed on the front side are continuously stapled in the set of sheets while the images formed in the sheets face each other, exists or not in the set of sheets.

In the embodiment, the control unit, in which the speed profile with an emphasis placed on the safety is selected for the set of sheets including the normal size which is often used only when all the following conditions are satisfied, i.e. the both-sides sheet exists in the set of sheets, the number of sheets is large, the set of sheets is stapled at one point, and both the image density is high in the surfaces facing each other in two sheets, and the speed profile in which the productivity is emphasized is selected in other cases, is shown as an example of the control unit described in the invention. However, the invention is not limited to the embodiment. The control unit described in the invention may be one in which the speed profile in which the safety is emphasized is selected when the pair of sheets exists in the set of sheets and it is decided that there is the risk for at least one criterion of the three criteria of the number of sheets, the number of points at which the set of sheets is stapled, and the image density. Further, the control unit described in the invention may be one which always selects the speed profile in which the safety is emphasized when the both-sides sheet exists in the set of sheets.

Figure 8:
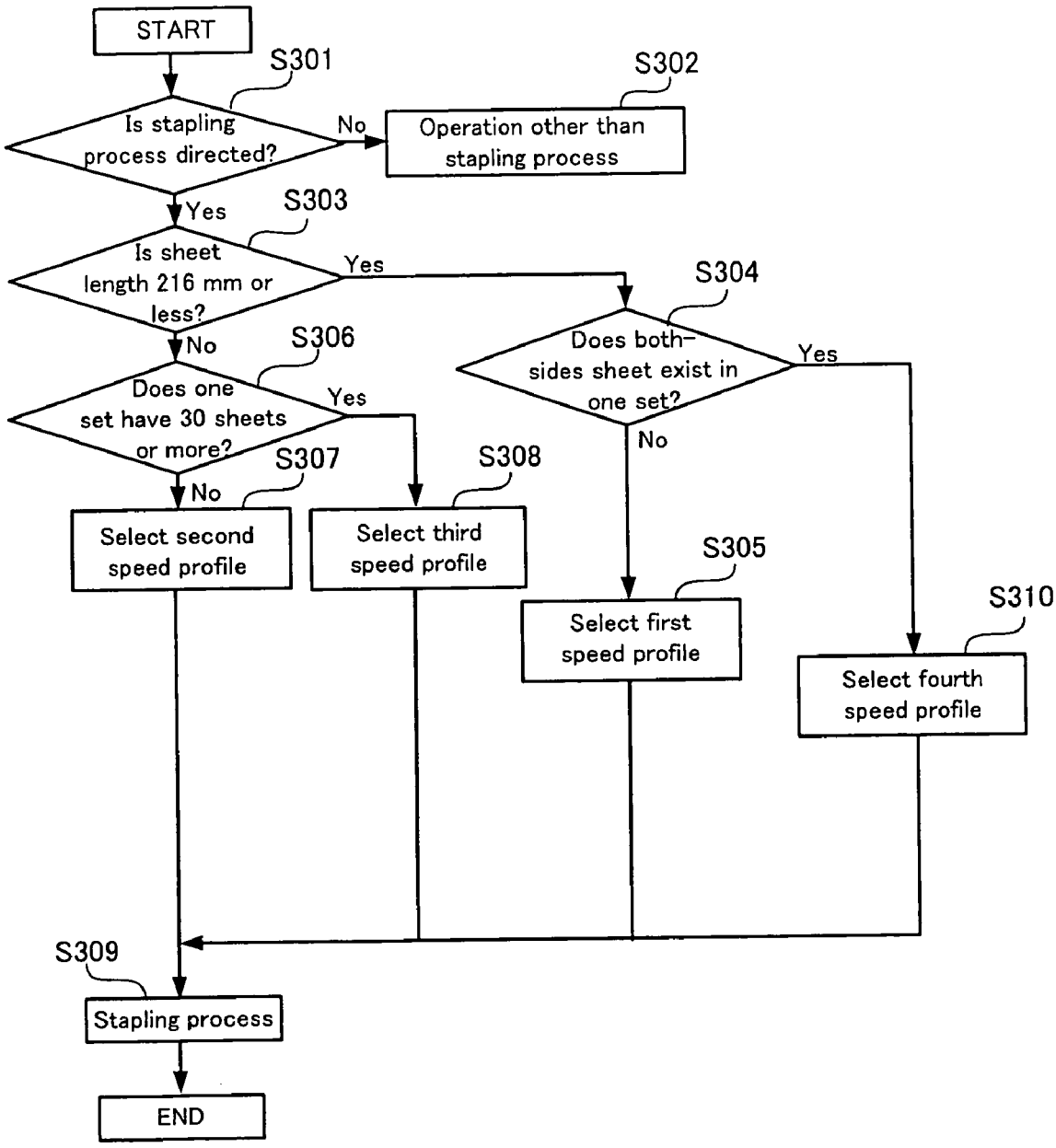
FIG. 8 is a flowchart showing the process of selecting the speed profile in the control unit included in the sheet output apparatus of a second embodiment.

FIG. 8 is a flowchart showing the process of selecting the speed profile in the control unit included in the sheet output apparatus according to a second embodiment.

Because the sheet output apparatus of the second embodiment has the same configuration as the sheet output apparatus shown in FIG. 1, not the overlapping description but the distinctive part of the sheet output apparatus of the second embodiment will be described. The control unit included in the sheet output apparatus of the second embodiment selects the speed profile in which the safety is emphasized whenever the both-sides sheet exists in the set of sheets. The same steps (Step S301 to Step S309) as the Step S201 to Step S205 and Step S213 to Step S216 shown in the flowchart of FIG. 5 are shown in the flowchart of FIG. 8. However, in the flowchart of FIG. 8, the processes of making the decisions of the number of sheets, the number of points at which the sheets are stapled, and the degree of the image density and the process of selecting the speed profile based on the decision results (Step S206 to Step S211) are not shown. Namely, in Step 304 of the flowchart shown in FIG. 8, it is decided whether the pair of sheets including the two sheets in which the formed images face each other exists in the plural sheets constituting the set of sheets. When the pair of sheets exists, the fourth speed profile SP4 in which the safety is emphasized is selected as the speed profile (Step S310). In Step S309, the stapling process is performed and the set of sheets is output according to the selected fourth speed profile SP4.

Another aspect of the present invention will be described below.

In the second aspect of the sheet output apparatus of the invention, in addition to the image forming information, the information obtaining unit may obtain density information showing an image density which is an occupation ratio of the image to a sheet surface on which the image is formed with respect to each of the plural sheets constituting the set of sheets; in addition to the decision whether the pair of sheets exists in the plural sheets constituting the set of sheets, when the predetermined condition is an image density condition that image density is not more than a predetermined value in two sheets facing each other in the pair of sheets, the decision unit may decide whether the image density condition is satisfied or not based on the density information; and the control unit may control the output unit to output the set of sheets by the first output force, even if the decision unit decides that the pair of sheets exists in the plural sheets constituting the set of sheets and decides that the image density condition is satisfied.

As described above, in the pair of sheets including two sheets in which the formed images face each other, the lubrication effect is enhanced by the toner which forms each image. However, when the image density of each image is low, since the amount of toner is small, the decrease in frictional force is suppressed between the sheets. Namely, even if the pair of the sheets exists, when the image density is low in the two sheets facing each other, there is a low possibility that the sheet slip from the set of sheets is generated. According to the sheet output apparatus of the invention, in this case, the set of sheets is also accelerated by the first output force, so that the productivity is further improved.

In the second aspect of the sheet output apparatus of the invention, in addition to the image forming information, the information obtaining unit may obtain sheet count information showing the number of the plural sheets constituting the set of sheets; in addition to the decision whether the pair of sheets exists in the plural sheets constituting the set of sheets, the decision unit may decide whether a predetermined condition is satisfied or not when the predetermined condition is a sheet count condition that the sheet count shown by the sheet count information is lower than the predetermined number of sheets; and the control unit may control the output unit to output the set of sheets by the first output force, even if the decision unit decides that the pair of sheets exists in the plural sheets constituting the set of sheets and decides that the sheet count condition is satisfied.

Even if the pair of the sheets exists in the plural sheets constituting the set of sheets, when the number of sheets is small and the set of sheets is thin, there is a low possibility that the sheet slip from the set of sheets is generated, because the force applied to at least one of the uppermost sheet and the lowermost sheet in the set of sheets is relatively easily transmitted to other sheets. According to the sheet output apparatus of the invention, also in this case, the set of sheets is accelerated by the first output force, so that the productivity is further improved.

In the second aspect of the sheet output apparatus of the invention, in addition to the image forming information, the information obtaining unit may obtain stapling information showing whether the sheet set generating unit staples the plural sheets at one point or plural points; in addition to the decision whether the pair of sheets exists in the plural sheets constituting the set of sheets, the decision unit may decide whether a predetermined condition is satisfied or not when the predetermined condition is a stapling condition that the plural stapling points shown by the stapling information exist; and the control unit may control the output unit to output the set of sheets by the first output force, even if the decision unit decides that the pair of sheets exists in the plural sheets constituting the set of sheets and decides that the stapling condition is satisfied.

Even if the pair of the sheets exists in the plural sheets constituting the set of sheets, when the plural sheets are stapled at the plural points with the stapler, there is a low possibility that the sheet slip from the set of sheets is generated, because binding force to each sheet is strong. According to the sheet output apparatus of the invention, also in this case, the set of sheets is accelerated by the first output force, so that the productivity is further improved.

The entire disclosure of Japanese Patent Application No. 2004-239340 filed on Aug. 19, 2004, including specification, claims, drawings and abstract, is incorporated herein by reference in its entirety.

What is claimed is:

1. A sheet output apparatus comprising:

a sheet set generating unit which generates a set of sheets by stapling a plurality of sheets stacked on a predetermined loading surface;

an information obtaining unit which obtains image forming information showing that an image is formed on any one of a front side of each sheet, a backside opposite to the front side, and both sides with respect to each of the plurality of sheets constituting the set of sheets generated by the sheet set generating unit;

a decision unit which decides whether a pair of sheets including two sheets in which the formed images face each other exists or not in the plurality of sheets constituting the set of sheets generated by the sheet set generating unit based on the image forming information obtained by the information obtaining unit;

an output unit which comes into contact with at least one of the uppermost sheet and the lowermost sheet in the set of sheets generated by the sheet set generating unit to apply a force outputting the set of sheets in a predetermined output direction to the sheet, the output unit outputting the set of sheets in the output direction by one of a predetermined first output force and a second output force smaller than the first output force; and a control unit which controls the output unit to output the set of sheets by the first output force when the decision result by the decision unit shows that the pair of sheets does not exist in the plurality of sheets constituting the set of sheets, the control unit controlling the output unit to output the set of sheets by the second output force when the decision result by the decision unit shows that the pair of sheets exists in the plurality of sheets constituting the set of sheets.

2. The sheet output apparatus comprising:

a sheet set generating unit which generates a set of sheets by stapling a plurality of sheets stacked on a predetermined loading surface;

an information obtaining unit which obtains image forming information showing that an image is formed on any one of a front side of each sheet, a backside opposite to the front side, and both sides with respect to each of the plurality of sheets constituting the set of sheets generated by the sheet set generating unit;

a decision unit which decides whether a pair of sheets including two sheets in which the formed images face each other exists or not in the plurality of sheets constituting the set of sheets generated by the sheet set generating unit based on the image forming information obtained by the information obtaining unit;

an output unit which comes into contact with at least one of the uppermost sheet and the lowermost sheet in the set of sheets generated by the sheet set generating unit to apply a force outputting the set of sheets in a predetermined output direction to the sheet, the output unit outputting the set of sheets in the output direction by one of a predetermined first output force and a second output force smaller than the first output force; and a control unit which controls the output unit to output the set of sheets by the first output force when the decision result by the decision unit shows that the pair of sheets does not exist in the plurality of sheets constituting the set of sheets, the control unit controlling the output unit to output the set of sheets by one of the first output force and the second output force according to the decision result about a predetermined condition further performed by the decision unit when the decision result by the decision unit shows that the pair of sheets exists in the plurality of sheets constituting the set of sheets.

3. The sheet output apparatus according to claim 2, wherein in addition to the image forming information, the information obtaining unit obtains density information showing an image density which is an occupation ratio of the image to a sheet surface on which the image is formed with respect to each of the plurality of sheets constituting the set of sheets, in addition to the decision whether the pair of sheets exists in the plurality of sheets constituting the set of sheets, when the predetermined condition is an image density condition that image density is not more than a predetermined value in two sheets facing each other in the pair of sheets, the decision unit decides whether the image density condition is satisfied or not based on the density information, and the control unit controls the output unit to output the set of sheets by the first output force, even if the decision unit decides that the pair of sheets exists in the plurality of sheets constituting the set of sheets and decides that the image density condition is satisfied.

4. The sheet output apparatus according to claim 2, wherein in addition to the image forming information, the information obtaining unit obtains sheet count information showing the number of the plurality of sheets constituting the set of sheets, in addition to the decision whether the pair of sheets exists in the plurality of sheets constituting the set of sheets, the decision unit decides whether a predetermined condition is satisfied or not when the predetermined condition is a sheet count condition that the sheet count shown by the sheet count information is lower than the predetermined number of sheets, and the control unit controls the output unit to output the set of sheets by the first output force, even if the decision unit decides that the pair of sheets exists in the plurality of sheets constituting the set of sheets and decides that the sheet count condition is satisfied.

5. The sheet output apparatus according to claim 2, wherein in addition to the image forming information, the information obtaining unit obtains stapling information showing whether the sheet set generating unit staples the plurality of sheets at one point or a plurality of points, in addition to the decision whether the pair of sheets exists in the plurality of sheets constituting the set of sheets, the decision unit decides whether a predetermined condition is satisfied or not when the predetermined condition is a stapling condition that the plurality of stapling points shown by the stapling information exist, and the control unit controls the output unit to output the set of sheets by the first output force, even if the decision unit decides that the pair of sheets exists in the plurality of sheets constituting the set of sheets and decides that the stapling condition is satisfied.

6. The sheet output apparatus according to claim 2, wherein in addition to the image forming information, the information obtaining unit obtains the sheet count information showing the number of the plurality of sheets constituting the set of sheets, the stapling information showing whether the sheet set generating unit staples the plurality of sheets at one point or the plurality of points, and the density information showing the image density which is the occupation ratio of the image to a sheet surface on which the image is formed with respect to each of the plurality of sheets constituting the set of sheets, in addition to the decision whether the pair of sheets exists in the plurality of sheets constituting the set of sheets, the decision unit decides whether predetermined conditions are satisfied or not when the predetermined conditions are the sheet count condition that the sheet count shown by the sheet count information is lower than the predetermined number of sheets, the stapling condition that the plurality of stapling points shown by the stapling information exist, and the image density condition that image density is not more than a predetermined value in two sheets facing each other in the pair of sheets, and the control unit controls the output unit to output the set of sheets by the second output force, when the decision unit decides that the pair of sheets exists in the plurality of sheets constituting the set of sheets and decides that none of the sheet count condition, the stapling condition, or the image density condition is satisfied.

* * * * *